US008991880B2

(12) United States Patent
Yokoyama et al.

(10) Patent No.: US 8,991,880 B2
(45) Date of Patent: Mar. 31, 2015

(54) DOOR HANDLE DEVICE

(71) Applicants: Mazda Motor Corporation, Aki-gun, Hiroshima (JP); U-Shin Ltd., Tokyo (JP)

(72) Inventors: Shigeharu Yokoyama, Aki-gun (JP); Tomoki Takahashi, Aki-gun (JP); Atsushi Naka, Aki-gun (JP)

(73) Assignees: Mazda Motor Corporation, Aki-gun (JP); U-Shin, Ltd., Tokyo (JP)

( * ) Notice: Subject to any disclaimer, the term of this patent is extended or adjusted under 35 U.S.C. 154(b) by 0 days.

(21) Appl. No.: 13/688,766

(22) Filed: Nov. 29, 2012

(65) Prior Publication Data

US 2013/0134723 A1 May 30, 2013

(30) Foreign Application Priority Data

Nov. 29, 2011 (JP) ..... 2011-259677

(51) Int. Cl.

| | |
|---|---|
| ***E05B 3/00*** | (2006.01) |
| ***E05B 85/10*** | (2014.01) |
| ***E05B 79/06*** | (2014.01) |
| ***E05B 85/16*** | (2014.01) |

(52) U.S. Cl.

CPC ..... *E05B 85/10* (2013.01); *E05B 79/06* (2013.01); *E05B 85/16* (2013.01); *Y10S 292/30* (2013.01); *Y10S 292/53* (2013.01); *Y10S 292/61* (2013.01); *Y10S 292/73* (2013.01)

USPC ..... 292/336.3; 292/DIG. 30; 292/DIG. 53; 292/DIG. 61; 292/DIG. 73

(58) Field of Classification Search

USPC ..... 292/336.3, DIG. 30, DIG. 53, DIG. 61, 292/DIG. 63, DIG. 73

See application file for complete search history.

(56) References Cited

U.S. PATENT DOCUMENTS

| | | | | |
|---|---|---|---|---|
| 4,482,179 | A * | 11/1984 | Johnson | 292/336.3 |
| 4,580,822 | A * | 4/1986 | Fukumoto | 292/336.3 |
| 5,263,750 | A * | 11/1993 | Smith et al. | 292/336.3 |
| 5,651,163 | A * | 7/1997 | Tamaki | 292/336.3 |
| 6,349,450 | B1 * | 2/2002 | Koops et al. | 292/336.3 |
| 6,464,270 | B1 * | 10/2002 | Sloan et al. | 292/336.3 |
| 2002/0089194 | A1 * | 7/2002 | Nomura et al. | 292/336.3 |
| 2012/0139271 | A1 * | 6/2012 | Saitou | 292/336.3 |

FOREIGN PATENT DOCUMENTS

JP 2007-002621 A 1/2007

* cited by examiner

*Primary Examiner* — Carlos Lugo
*Assistant Examiner* — Christine M Mills
(74) *Attorney, Agent, or Firm* — Westerman, Hattori, Daniels & Adrian, LLP

(57) ABSTRACT

A door handle device includes: a base member having handle supporting portions provided between a pair of supporting boards facing each other; a handle grip provided with an arm portion protruding at one end of the handle grip, shaft support portions provided on an extreme end of the arm portion and pivotally supported by the handle supporting portions of the base member, and an operating portion provided at the other end of the handle grip and configured to operate a lever provided on the base member; and a double torsion spring having a restriction portion extending between the pair of supporting boards of the base member, and hooked to the supporting boards of the base member by its own biasing force, in which a recessed portion with which the restriction portion of the double torsion spring is engaged is formed in the arm portion of the handle grip.

3 Claims, 7 Drawing Sheets

DOOR HANDLE DEVICE

BACKGROUND OF THE INVENTION

1. Field of the Invention

The present invention relates to a door handle device for unlocking a door for a vehicle by operation of a handle grip.

2. Description of the Related Art

A door handle device for unlocking a door for a vehicle includes a base member fixed to a door panel, and a handle grip pivotally supported at one end on the base member. In such a door handle device, when an occupant operates the handle grip in order to open the door, a lever provided on the base member operates to unlock the door for the vehicle locked by a door lock device, thus allowing the occupant to open the door for the vehicle.

Incidentally, for the door handle device, Japanese Patent Application Publication No. 2007-002621 proposes a configuration in which a fixing piece provided with concavely grooved support portions accommodating a pivot shaft of the handle grip is fastened to a frame by a nut and a bolt. According to the configuration, engagement of the pivot shaft of the handle grip with the support portions of the fixing piece prevents the handle grip from rattling in its longitudinal direction. Also, the bolt is rotated to move the fixing piece and permit disengagement of the pivot shaft of the handle grip from the support portions of the fixing piece, thereby facilitating attachment and detachment of the handle grip and thus enhancing ease of assembly operation for the door handle device.

However, the configuration proposed in Japanese Patent Application Publication No. 2007-002621 has the problem of requiring a lot of labor and time for assembly of the fixing piece to the frame, because of a need to fix the fixing piece to the frame by the nut and the bolt.

SUMMARY OF THE INVENTION

The present invention has been made in view of the foregoing problem. An object of the present invention is to provide a door handle device capable of enhancing ease of assembly operation, as well as preventing a handle grip from rattling.

In order to attain the above object, a first aspect of the present invention provides a door handle device including: a base member fixed to a door panel of a vehicle, and having handle supporting portions provided between a pair of supporting boards facing each other; a handle grip provided with an arm portion protruding at one end of the handle grip, shaft support portions provided on an extreme end of the arm portion and pivotally supported by the handle supporting portions of the base member, and an operating portion provided at the other end of the handle grip and configured to operate a lever provided on the base member; and a resilient member having a restriction portion extending between the pair of supporting boards of the base member, and hooked to the supporting boards of the base member by its own biasing force, in which a recessed portion with which the restriction portion of the resilient member is engaged is formed in the arm portion of the handle grip.

According to a second aspect of the present invention, in the first aspect, the arm portion of the handle grip is provided with a sloping face to guide the restriction portion of the resilient member to the recessed portion against the biasing force.

According to a third aspect of the present invention, in the first or second aspect, the resilient member has a biasing force for biasing the handle grip toward its initial position before operation.

According to a fourth aspect of the present invention, in any one of the first to third aspect, the resilient member is formed of a double torsion spring including locking portions provided on ends thereof, respectively, and coil portions provided between the locking portions and the restriction portion, and the supporting boards of the base member are provided with protruding portions which support the coil portions, respectively, of the double torsion spring, and spring locking portions with which the locking portions are locked, respectively.

According to a fifth aspect of the present invention, in the fourth aspect, the protruding portions provided on the supporting boards of the base member are disposed coaxially with a fulcrum on which the handle grip pivots.

According to the first aspect, the restriction portion of the resilient member is engaged with the recessed portion formed in the arm portion of the handle grip, and thus, the handle grip pivots about the handle supporting portions of the base member with reliability without rattling, thereby to unlock the door for the vehicle. Also, the resilient member is hooked to the supporting boards of the base member by its own biasing force, and thus, the resilient member can be easily attached to the base member without the use of a fastening member such as a bolt.

According to the second aspect, at the time of attachment of one end of the handle grip to the handle supporting portions of the base member, the restriction portion of the resilient member is engaged with the recessed portion by being guided to the recessed portion along the sloping face provided on the arm portion of the handle grip. Therefore, the handle grip is attached to the base member by being slid relative to the base member and thereby the restriction portion of the resilient member is automatically engaged with the recessed portion of the handle grip, thus enhancing ease of assembly operation for the door handle device.

According to the third aspect, the handle grip is biased toward its initial position before operation (or in a direction of "closed" position) by the biasing force of the resilient member, to thus prevent the occurrence of a malfunction, specifically prevent the handle grip from being accidentally actuated in a direction of "open" position by an inertial force under external shocks and in turn unlocking the door for the vehicle.

According to the fourth aspect, the resilient member is formed of the double torsion spring, and thus, the double torsion spring can be easily mounted to the base member and the double torsion spring can be prevented from falling out by vibration or the like.

According to the fifth aspect, the protruding portions provided on the supporting boards of the base member are disposed coaxially with the fulcrum on which the handle grip pivots, and thus, the restriction portion of the double torsion spring pivots about the protruding portions as a fulcrum, which are coaxial with the handle supporting portions of the base member as the fulcrum on which the handle grip pivots. Thus, even when the handle grip is in a position operated in the direction of "open" position, the restriction portion of the double torsion spring can maintain its engagement with the recessed portion of the handle grip to thus suppress diametrical rattling of the handle grip during operation, so that the handle grip can be operated with reliability without rattling, thereby to unlock the door for the vehicle.

DETAILED DESCRIPTION OF THE PREFERRED EMBODIMENT

An embodiment of the present invention will be described below with reference to the accompanying drawings.

Figure 1:
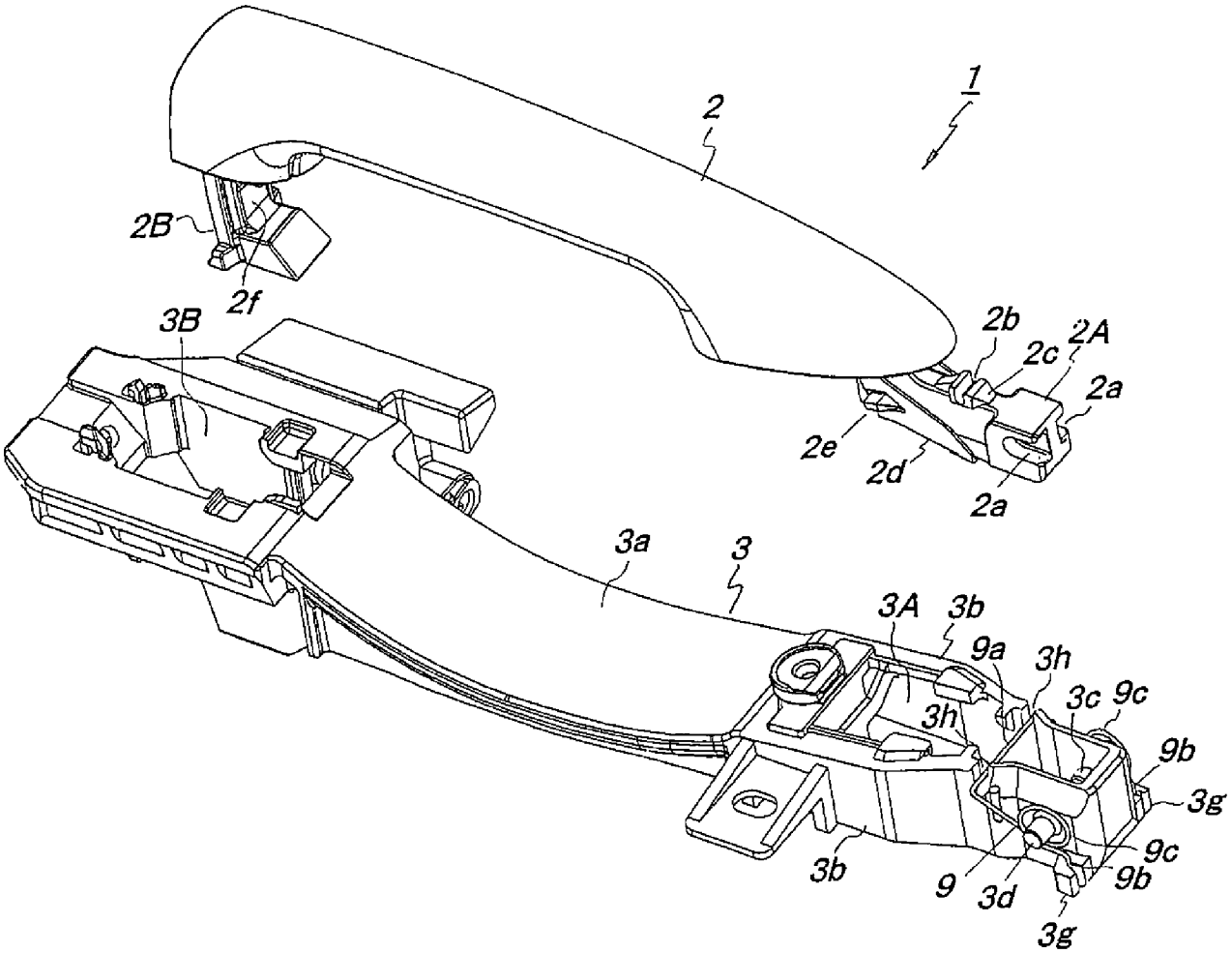
FIG. 1 is an exploded perspective view of a door handle device according to the present invention.
Figure 2:
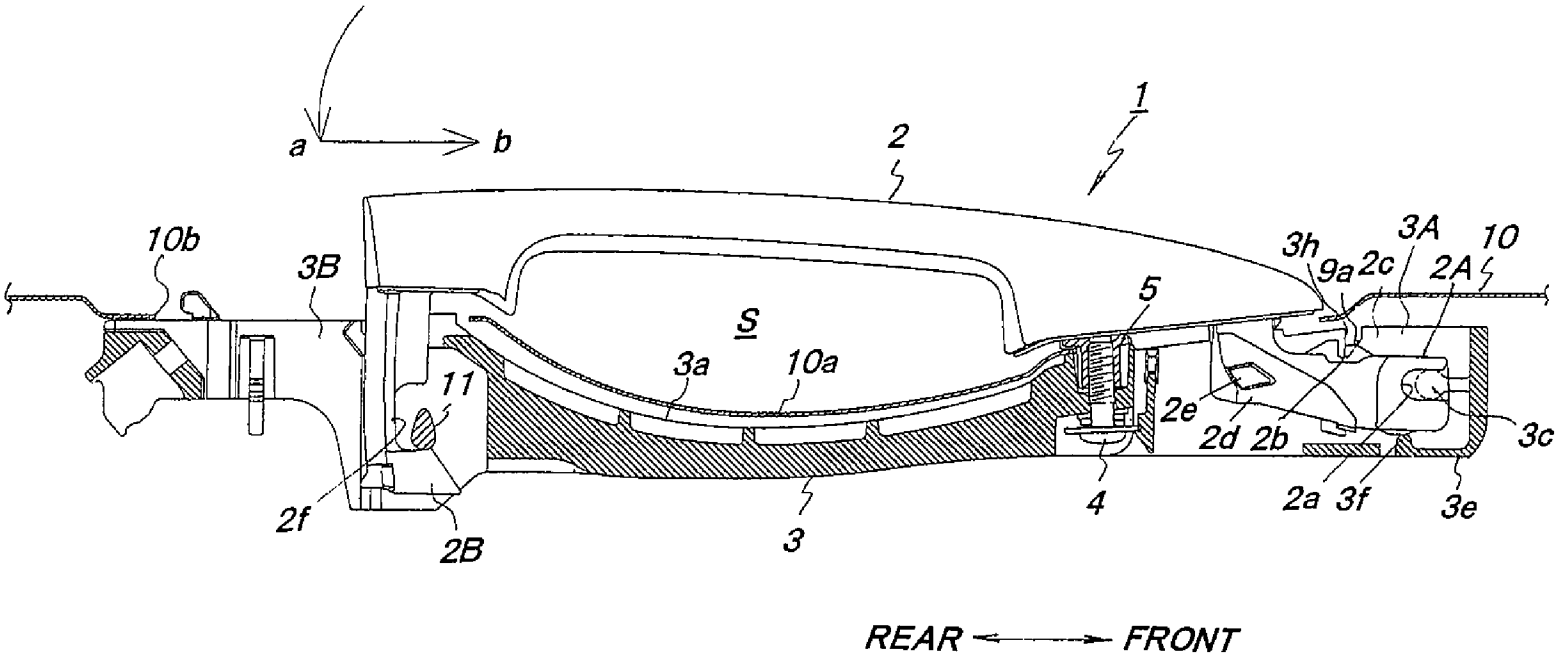
FIG. 2 is a longitudinal sectional view showing an assembly procedure for the door handle device according to the present invention.
Figure 3:
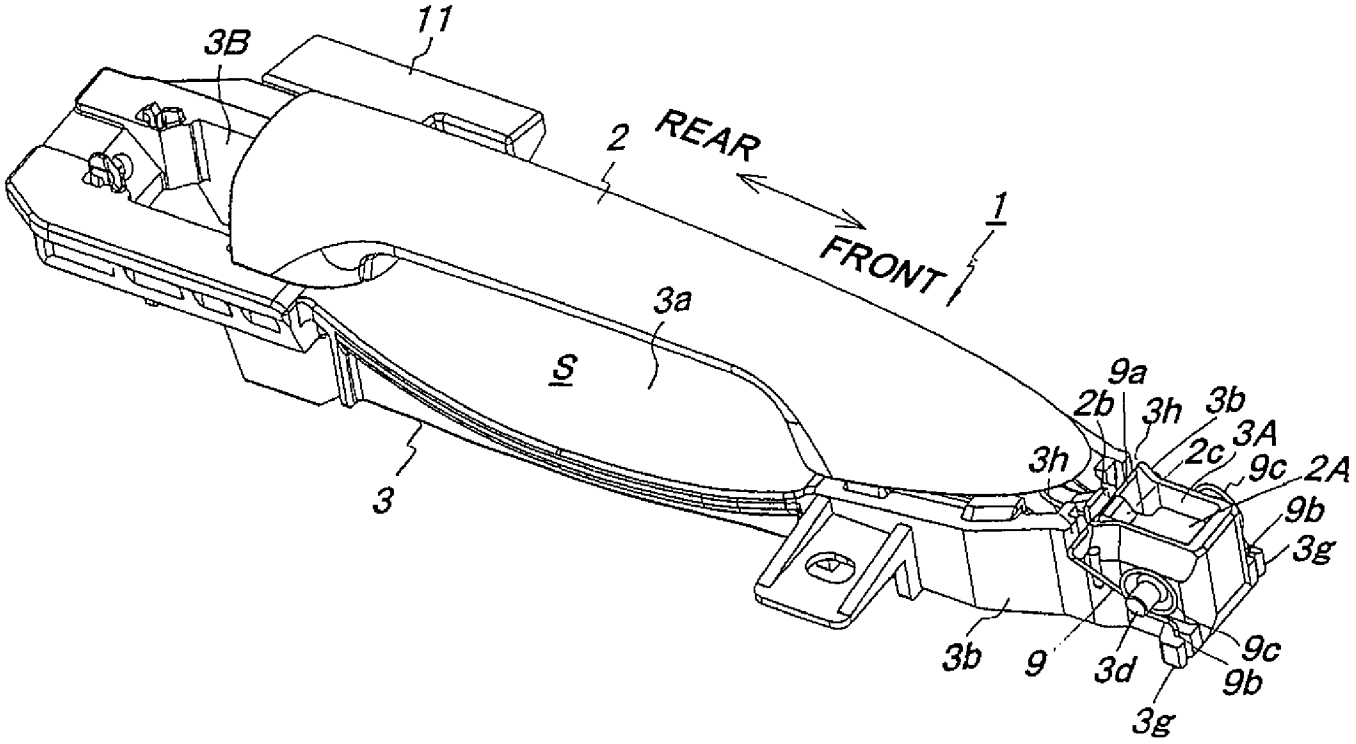
FIG. 3 is a perspective view of the door handle device according to the present invention.
Figure 4:
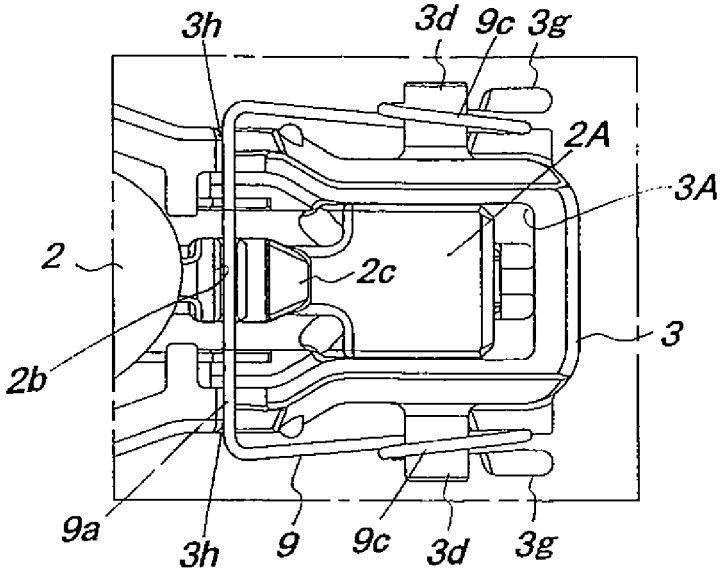
FIG. 4 is a plan view of a principal part of the door handle device according to the present invention.
Figure 5:
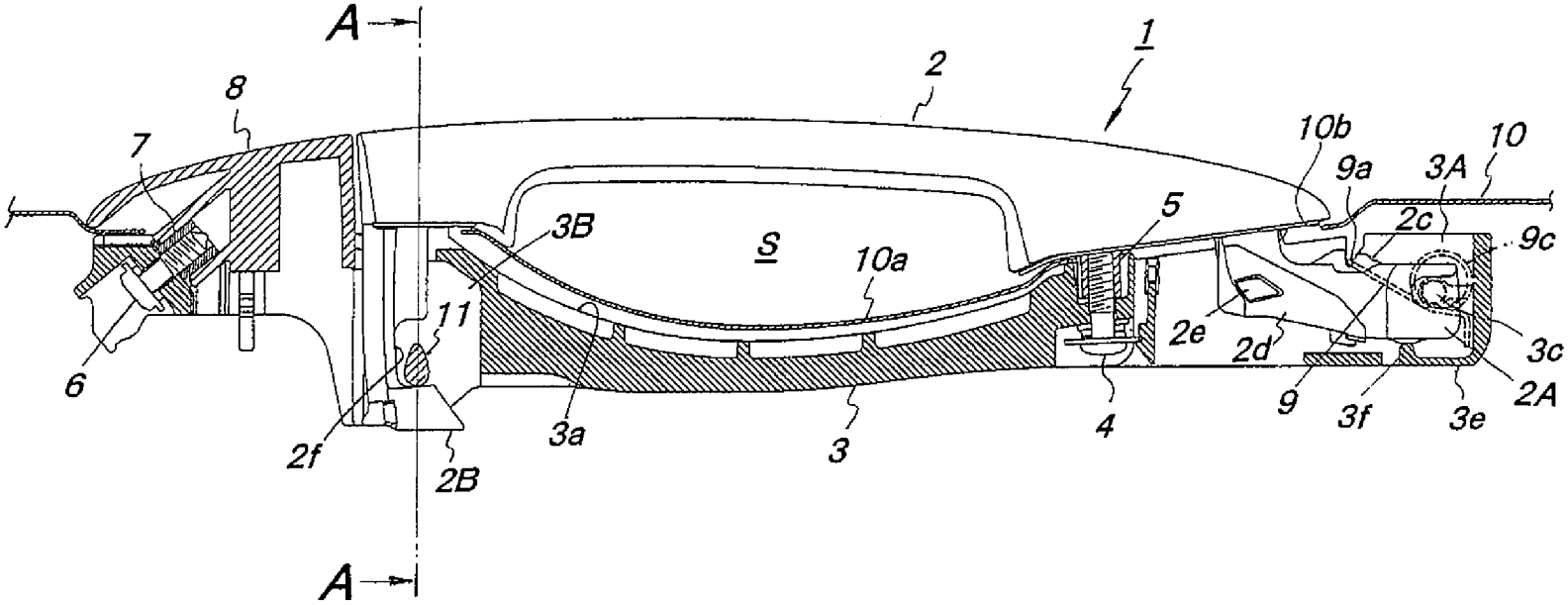
FIG. 5 is a longitudinal sectional view showing the door handle device according to the present invention as in a non-operated position.
Figure 6:
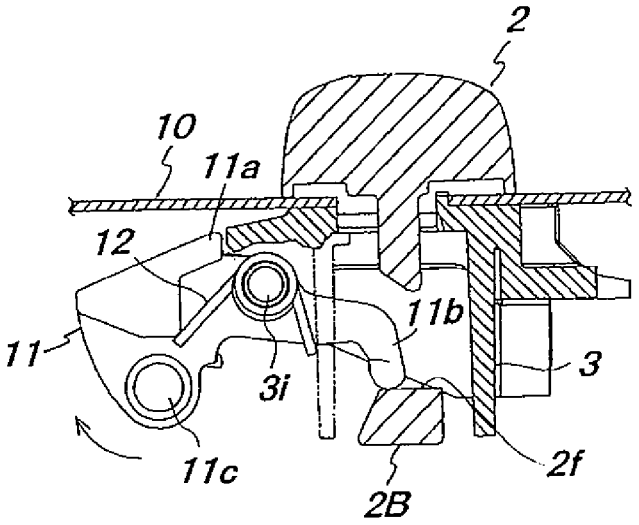
FIG. 6 is a sectional view taken along line A-A of FIG. 5.
Figure 7:
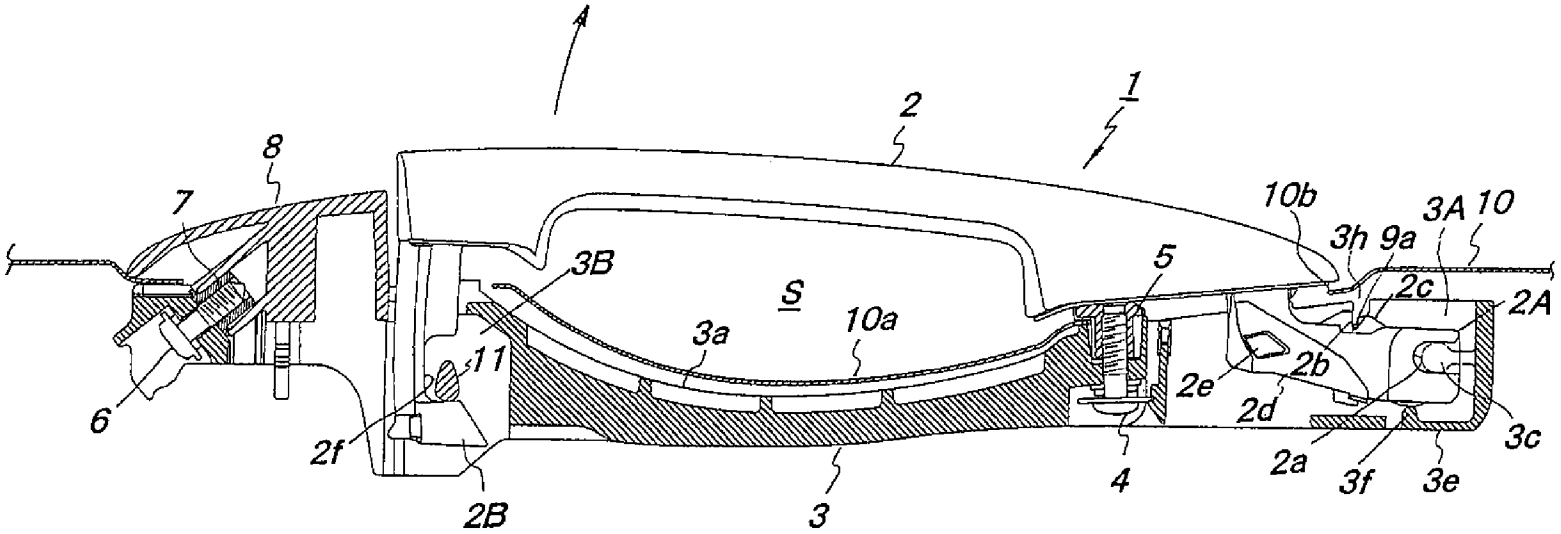
FIG. 7 is a longitudinal sectional view showing the door handle device according to the present invention as in an operated position.

FIG. 1 is an exploded perspective view of a door handle device according to the present invention; FIG. 2 is a longitudinal sectional view showing an assembly procedure for the door handle device; FIG. 3 is a perspective view of the door handle device; FIG. 4 is a plan view of a principal part of the door handle device; FIG. 5 is a longitudinal sectional view showing the door handle device as in a non-operated position; FIG. 6 is a sectional view taken along line A-A of FIG. 5; and FIG. 7 is a longitudinal sectional view showing the door handle device as in an operated position.

A door handle device 1 according to the present invention is installed on a door for a vehicle, and includes a handle grip 2 configured in order for an occupant to grasp and operate it, and a base member 3 which pivotally supports one end of the handle grip 2.

The handle grip 2 is a member oriented with its length extending in a vehicle longitudinal direction (e.g. a direction from side to side of the sheet as seen in FIG. 2), and is provided at one end (or its front end) with an arm portion 2A extending horizontally, and at the other end (or its rear end) with an operating portion 2B protruding at a right angle inward (e.g. downward as seen in FIGS. 1 and 2).

Here, as shown in FIG. 1, shaft support portions 2*a* in the form of lateral U-grooves opening at their front ends are formed in the sides, respectively, of the extreme end of the arm portion 2A of the handle grip 2. Also, a longitudinally intermediate portion of a top surface of the arm portion 2A is provided with a recessed portion 2*b* in the form of a groove formed therethrough laterally (or in a direction from top to bottom, when in assembled position), and a sloping face 2*c* inclined in such a way as to increase in height toward the recessed portion 2*b* is formed forward of the recessed portion 2*b*.

Further, the left and right sides of the arm portion 2A of the handle grip 2 are provided with flexible handle sheets 2*d*, respectively, as cushioning material to prevent a striking sound from being produced by the arm portion 2A striking the base member 3 during pivoting operation of the handle grip 2. Then, the handle sheets 2*d* are provided with protrusion portions 2*e* (one only of which is shown in FIGS. 1 and 2) protruding from the handle sheets 2*d*, respectively, and the protrusion portions 2*e* are configured to restrict the handle grip 2 from pivoting, by engagement with stoppers (unillustrated) provided on the base member 3.

Also, an engagement recess portion 2*f* is formed in the operating portion 2B provided on the other end (or the rear end) of the handle grip 2 and protruding therefrom at a right angle.

On the other hand, as shown in FIG. 5, the base member 3 is mounted on an inner surface of a door panel 10, and the mounting of the base member 3 to the door panel 10 is accomplished by sandwiching the door panel 10 in by a screw 4 and a nut 5 on the front side and a screw 6, a nut 7 and an end cover 8 on the rear side. The base member 3 is provided with a concave portion 3*a* along a concavity 10*a* of the door panel 10, and space (or clearance) S configured in order for the occupant to insert his or her hand thereinto is formed between the concave portion 3*a* and the handle grip 2.

Also, as shown in FIG. 1, an arm portion housing portion 3A in the form of a box for housing the arm portion 2A of the handle grip 2, and a rectangular through-hole 3B are formed in a front end portion and a rear end portion, respectively, of the base member 3. Here, the arm portion housing portion 3A is formed between a pair of supporting boards 3*b* facing each other, and inner surfaces of front end portions of the pair of supporting boards 3*b* are provided with handle supporting portions 3*c*, respectively, in the form of pins, and also, outer surfaces of the front end portions of the supporting boards 3*b* are provided with protruding portions 3*d* likewise in the form of pins, protruding coaxially with the handle supporting portions 3*c*. Incidentally, as shown in FIGS. 2 and 5, a leaf spring 3*e* is integrally formed with a bottom portion of a front end of the arm portion housing portion 3A of the base member 3, and a top surface of the leaf spring 3*e* is provided with a protrusion 3*f* protruding therefrom.

Further, spring locking portions 3*g* are formed in lower portions, respectively, of the sides of the front end of the arm portion housing portion 3A of the base member 3, and notch grooves 3*h* are formed in upper portions, respectively, of the pair of left and right supporting boards 3*b*. Then, a U-shaped double torsion spring 9 as a resilient member is hooked to the front end portions of the left and right supporting boards 3*b* of the base member 3.

The double torsion spring 9 has a restriction portion 9*a* extending between the pair of supporting boards 3*b* of the base member 3, and is hooked to the supporting boards 3*b* of the base member 3 by its own biasing force. Here, ends (or free ends) of the double torsion spring 9 are provided with locking portions 9*b*, respectively, and coil portions 9*c* are provided between the locking portions 9*b* and the restriction portion 9*a*. As shown in FIGS. 1 and 4, first, the left and right coil portions 9*c* are supported by the left and right protruding portions 3*d*, respectively, of the base member 3, and then, the restriction portion 9*a* is engaged with the notch grooves 3*h* of the pair of supporting boards 3*b* of the base member 3, and finally, the locking portions 9*b* on the left and right end portions (or free ends) are engaged with the spring locking portions 3*g*, respectively, formed on the front end of the base member 3. Thereby, as described above, the double torsion spring 9 is hooked to the pair of supporting boards 3*b* of the base member 3 with the biasing force acting in a clockwise direction as seen in FIG. 1.

On the other hand, the operating portion 2B of the handle grip 2 is inserted into the through-hole 3B of the base member 3 as shown in FIGS. 3 and 5, while a lever 11 is pivotally supported by a shaft portion 3*i* of the base member 3 on the side of the through-hole 3B of the base member 3 as shown in FIG. 6. The lever 11 is biased in a direction of arrow of FIG. 6 (or a door lock direction) by a torsion spring 12 wound around the shaft portion 3*i* and is restricted in its position as shown in the drawing by its stopper portion 11*a* abutting against the base member 3, and, when the lever 11 is in this position, an operation receiver 11*b* of the lever 11 is engaged with the engagement recess portion 2*f* formed in the operating portion 2B of the handle grip 2 thereby to bias the handle grip 2 downward as seen in FIG. 6 (or in the door lock direction). Incidentally, one end of a rod (unillustrated) is linked to a rod linking portion 11*c* of the lever 11, and the other end of the rod is linked to a door lock device (unillustrated).

Next, description will be given with regard to an assembly procedure for the door handle device 1 including the handle grip 2, the base member 3 and the double torsion spring 9.

In assembly of the door handle device 1, first, the double torsion spring 9 is hooked to the base member 3 as described above, and also, the lever 11 is attached to the base member 3.

Then, the base member 3 is attached to the door panel 10 from the inside of a vehicle body, and the base member 3 is temporarily tacked to the door panel 10 by the screw 4 and the nut 5, and after that, the handle grip 2 is attached to the base member 3 by being passed through an attachment hole 10*b* (see FIG. 2) of the door panel 10 from the outside of the vehicle. At this time, the arm portion 2A is first inserted into the arm portion housing portion 3A of the base member 3 by slightly tilting the handle grip 2, and the left and right handle supporting portions 3*c* of the base member 3 are engaged with the shaft support portions 2*a*, respectively, formed in the sides of the extreme end portion of the arm portion 2A as shown in FIG. 2. Then, the handle grip 2 is pivoted from that position in a direction of arrow a of FIG. 2, the operating portion 2B protruding from the rear end portion of the handle grip 2 is inserted into the through-hole 3B of the base member 3, and the handle grip 2 is forced in a direction of arrow b of FIG. 2 (or toward the vehicle front) with the handle grip 2 kept substantially in a horizontal position.

Then, the sloping face 2*c* provided on the arm portion 2A of the handle grip 2 forces the restriction portion 9*a* of the double torsion spring 9 upward against a biasing force thereby to guide the restriction portion 9*a* to the recessed portion 2*b* of the handle grip 2. Then, when the handle grip 2 is further forced in, as shown in FIG. 5, the handle supporting portions 3*c* of the base member 3 are completely engaged with the left and right shaft support portions 2*a*, respectively, of the handle grip 2, and the handle grip 2 is pivotally supported so that it is pivotable about the handle supporting portions 3*c* of the base member 3. Also, the restriction portion 9*a* of the double torsion spring 9 is engaged with the recessed portion 2*b* of the handle grip 2 by its own restoring force (see FIG. 4), and the handle grip 2 is restricted in diametrical movement relative to the handle supporting portions 3*c* of the base member 3 by the restriction portion 9*a* of the double torsion spring 9 and also is biased toward its initial position before operation (e.g. its FIG. 5 position). In other words, the double torsion spring 9 has a biasing force for biasing the handle grip 2 toward its initial position before operation. Also, as shown in FIG. 5, the protrusion 3*f* of the leaf spring 3*e* of the base member 3 abuts against a bottom surface of the arm portion 2A of the handle grip 2, and thus, the shaft support portions 2*a* of the arm portion 2A are biased toward the handle supporting portions 3*c* of the base member 3 (e.g. upward as seen in FIG. 5) thereby to suppress upward and downward rattling of the handle grip 2.

Then, when the end cover 8 is finally fixed by the screw 6, the base member 3 is mounted to the door panel 10 in such a manner that the base member 3 cannot fall out, so that the door handle device 1 is assembled as shown in FIGS. 3 and 5.

Thus, in the door handle device 1 assembled as described above, when the occupant inserts his or her hand into the space (or clearance) S between the handle grip 2 and the base member 3, grasps the handle grip 2 and pulls the handle grip 2 toward him or her (e.g. upward as seen in FIG. 7), the handle grip 2 pivots about the handle supporting portions 3*c* of the base member 3 in a direction of arrow of FIG. 7. When the handle grip 2 pivots in this manner, the operating portion 2B of the handle grip 2 acts on the operation receiver 11*b* of the lever 11 thereby to cause the lever 11 shown in FIG. 6 to pivot about the shaft portion 3*i* in the opposite direction to the arrow of FIG. 6 (or in a counterclockwise direction as seen in FIG. 6) against a biasing force of the torsion spring 12, and thus, the door lock device (unillustrated) is operated through the rod (unillustrated) linked to the rod linking portion 11*c* of the lever 11, thereby to unlock the door locked by the door lock device and thus allow the occupant to open the door.

In accordance with the above, according to the door handle device 1 according to the present invention, the restriction portion 9*a* of the double torsion spring 9 is engaged with the recessed portion 2*b* formed in the arm portion 2A of the handle grip 2, and thus, the handle grip 2 pivots about the handle supporting portions 3*c* of the base member 3 with reliability without rattling, thereby to unlock the door for the vehicle. Then, the double torsion spring 9 is hooked to the supporting boards 3*b* of the base member 3 by its own biasing force, and thus, the double torsion spring 9 can be easily attached to the base member 3 without the use of a fastening member such as a bolt.

Also, according to the door handle device 1 according to the present invention, at the time of attachment of one end of the handle grip 2 to the handle supporting portions 3*c* of the base member 3, the restriction portion 9*a* of the double torsion spring 9 is engaged with the recessed portion 2*b* by being guided to the recessed portion 2*b* along the sloping face 2*c* provided on the arm portion 2A of the handle grip 2, and thus, the handle grip 2 is attached to the base member 3 by being slid relative to the base member 3 and thereby the restriction portion 9*a* of the double torsion spring 9 is automatically engaged with the recessed portion 2*b* of the handle grip 2. Thus, the double torsion spring 9 can be easily mounted to the handle grip 2. Also, the resilient member is formed of the double torsion spring 9, and thus, the double torsion spring 9 can be easily mounted to the base member 3 and the double torsion spring 9 can be prevented from falling out by vibration or the like.

Further, in the door handle device 1 according to the present invention, the handle grip 2 is biased toward its initial position before operation (or in a direction of "closed" position) by the biasing force of the double torsion spring 9, to thus prevent the occurrence of a malfunction, specifically prevent the handle grip 2 from being accidentally actuated in a direction of "open" position by an inertial force under external shocks and in turn unlocking the door for the vehicle.

Also, in the door handle device 1 according to the present invention, the protruding portions 3*d* provided on the supporting boards 3*b* of the base member 3 are disposed coaxially with the handle supporting portions 3*c*, and thus, the restriction portion 9*a* of the double torsion spring 9 pivots about the protruding portions 3*d* as a fulcrum, which are coaxial with the handle supporting portions 3*c* of the base member 3 as a fulcrum on which the handle grip 2 pivots. Thus, even when the handle grip 2 is in a position operated in the direction of "open" position, the restriction portion 9*a* of the double torsion spring 9 can maintain its engagement with the recessed portion 2*b* of the handle grip 2 to thus suppress diametrical rattling of the handle grip 2 during operation, so that the handle grip 2 can be operated with reliability without rattling, thereby to unlock the door for the vehicle.

Incidentally, in the embodiment, a configuration is such that the shaft support portions 2*a* of the handle grip 2 are formed in the shape of lateral U-grooves, and the handle supporting portions 3*c* of the base member 3 are provided in the form of pins, and the handle grip 2 is pivotally supported on the base member 3; however, it is to be understood that the present invention is not so limited, and for example, as opposed to the above, a configuration may be such that the shaft support portions 2*a* of the handle grip 2 are provided protruding in the form of pins and the handle supporting portions 3*c* of the base member 3 are formed in the shape of lateral U-grooves. In this case, the shaft support portions 2*a* serve as the fulcrum on which the handle grip 2 pivots, and the protruding portions 3*d* are provided so as to be coaxial with the shaft support portions 2*a*, and thereby, even when the handle grip 2 is in the position operated in the direction of "open" position, the restriction portion 9*a* of the double torsion spring 9 can maintain its engagement with the recessed portion 2*b* of the handle grip 2 to thus enable suppressing diametrical rattling of the handle grip 2.

What is claimed is:

1. A door handles device comprising:

a base member fixed to a door panel of a vehicle, and having handle supporting portions provided between a pair of supporting boards facing each other;

a handle grip provided with an arm portion protruding at one end of the handle grip, shaft support portions provided on an extreme end of the arm portion away from the one end of the handle grip and pivotally supported directly by the handle supporting portions of the base member, and an operating portion provided at the other end of the handle grip and configured to operate a lever provided on the base member, the shaft support portions also fitting between the pair of supporting boards; and a resilient member having a restriction portion extending between the pair of supporting boards of the base member, the resilient member being hooked to the supporting boards of the base member by a biasing force of the resilient member biasing the handle grip toward its initial position before operation, wherein a recessed portion with which the restriction portion of the resilient member is engaged from a top of the arm portion to bias toward the handle supporting portions is formed in the arm portion of the handle grip, wherein the resilient member is formed of a double torsion spring including locking portions provided on ends thereof, respectively, and coil portions provided between the locking portions and the restriction portion, and wherein the supporting boards of the base member are provided with protruding portions which support the coil portions, respectively, of the double torsion spring, and spring locking portions with which the locking portions are locked, respectively.

2. The door handle device according to claim 1, wherein the arm portion of the handle grip is provided with a sloping face to guide the restriction portion of the resilient member to the recessed portion against the biasing force.

3. The door handle device according to claim 1, wherein the protruding portions provided on the supporting boards of the base member are disposed coaxially with a fulcrum on which the handle grip pivots.

* * * * *